United States Patent [19]

Hsu

[11] 3,983,993

[45] Oct. 5, 1976

[54] CANTEEN WITH WATER COLOR PAINTING ACCESSORIES

[75] Inventor: Sheau-Po Hsu, Hu Wei Town, Yunlin Hsien, China /Taiwan

[73] Assignee: Eic International Corporation, Taipei, China /Taiwan

[22] Filed: Dec. 4, 1975

[21] Appl. No.: 637,662

[52] U.S. Cl. ..... 206/1.7; 224/5 W; 224/46 R; 220/23; 220/86; 220/9 R

[51] Int. Cl.[2] ..... B05C 17/00; A47G 19/00

[58] Field of Search ..... 224/5 R, 5 W, 46 R, 224/46 T, 45 G, 45 Q, 48 F; 206/1.7–1.9; 220/23.83, 23.86, 4 E, 9 R, 10, 16

[56] References Cited

UNITED STATES PATENTS

| | | | |
|---|---|---|---|
| 1,471,793 | 10/1923 | Israel | 220/23 |
| 2,565,912 | 8/1951 | Davis | 206/1.7 |
| 2,672,232 | 3/1954 | Kessel, Jr. | 220/23 |
| 3,273,700 | 9/1966 | Moreau et al. | 220/23 |
| 3,924,733 | 12/1975 | Delong | 206/1.7 |

*Primary Examiner*—George E. Lowrance
*Assistant Examiner*—Douglas B. Farrow
*Attorney, Agent, or Firm*—Burns, Doane, Swecker & Mathis

[57] ABSTRACT

Canteen with water color painting accessories comprising through one side wall of a canteen, a cylindrical central recess to take a cup for brush washing, on the surface of the said wall, a tray with radial disposed compartments being provided to hold tubes of water color, a cover of the tray with a central opening of the same diameter as the said central recess of the canteen and also with multi-sections serving as color mixing pallet, the washing cup being inversely screwed into the central recess to retain the cover on the tray.

3 Claims, 2 Drawing Figures

CANTEEN WITH WATER COLOR PAINTING ACCESSORIES

FIELD OF THE INVENTION

The present invention relates generally to a canteen and more particularly to a canteen with water color painting accessories. The accessories include a built in color tube holding tray, a cover attached thereon and serving as color mixing pallet and a brush washing cup screwed into the central recess of the canteen through one of the side walls of the canteen. In addition to serve the usual purpose of a water canteen, the equipment facilitates water color painter during an outdoor sketching trip without carrying extra painting box.

BACKGROUND OF INVENTION

Painters used to travel around scenery spots to sketch down landscapes or seascapes, especially water color painters who wish to finish the preliminary sketch with water color right on the spot. To carry along a painting box which contains necessary accessories such as color tubes, mixing pallet and brush washing cup seems quite inconvenient to those who take trip for pleasure. Besides, when school boy is doing such a job, the painting box is some what a burden to him. However, a water canteen with shoulder strap is a popular item to go with a sightseer, it is a practical idea to combine a whole set of necessary accessories into a water canteen for handy use.

SUMMARY OF INVENTION

Therefore, the main object of the present invention is to provide a canteen with water color painting accessories which consist of a built in tray for holding water color tubes, a cover serving as mixing pallet and a brush washing cup to meet the requirement of an outdoor painter.

Another object of the present invention is to provide a canteen with water color painting accessories that is easily carried along by water color painter without bothering to carry an extra painting box during a sketching trip.

Other objects and features will become apparent from the following detailed description to be taken in conjunction with the annexed drawings.

DETAIL DESCRIPTION OF EMBODIMENT

Figure 1:
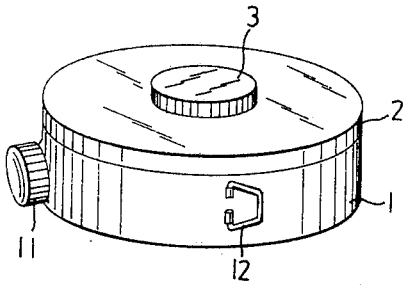
FIG. 1 depicts a perspective view of a preferred embodiment of the canteen with water color painting accessories of the present invention.

Referring to FIG. 1, the canteen with water color painting accessories comprises a canteen body 1 with cap 11 and shoulder strap hanger 12, a cover 2 serving as color mixing pallet, and a cup 3 screwed into a central recess through one of the side walls of the canteen.

Figure 2:
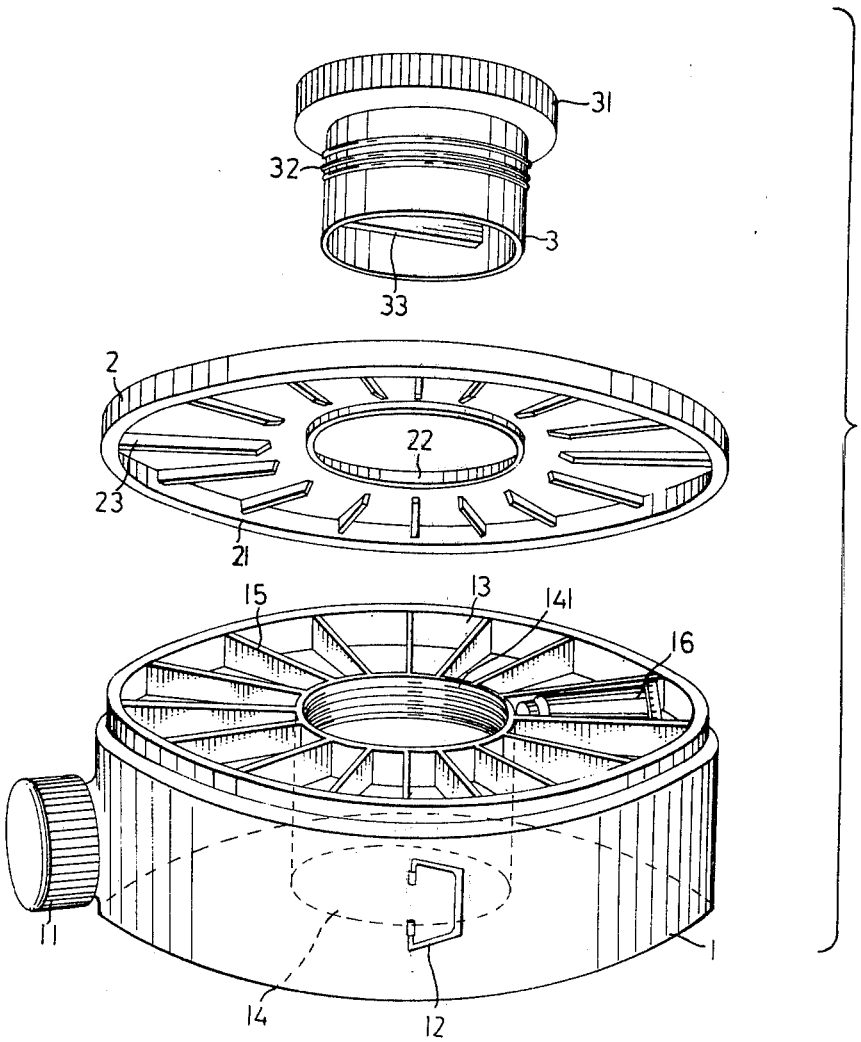
FIG. 2 is an exploded perspective view of the above embodiment.

In FIG. 2, the central recess 14 is shown in dotted line, the doughnut like space surrounding recess 14 within the canteen body 1 is for filling of drinking water. Inside the cylindrical recess and on top of which, female threads 141 are provided to match the male threads 32 outside the brush washing cup 3 which is shown upside down in FIG. 2.

A tray built-in on one of the side walls of the canteen with radial partition members 15 which connect the raised rim of the recess 14 and the outer wall 13 of the tray constitute a plurality of compartment for holding water color tubes 16. A cover 2 with outer circular rim 21 is to be covered on the tray. The cover 2 with a central opening 22 having same inside diameter as that of the recess 14 to take the cup 3 during assembling.

The cover 2 is served as a color mixing pallet and having multiple sections 23 to meet the purpose.

The cup 3 having a base 31 of larger diameter and a cup of outside diameter suitable for inserting into the opening 22 of the cover 2 and the recess 14 of the canteen body 1. Male threads 32 are provided outside the cup 3 for screwing together with the female threads 141 inside the recess 14. Vertical partition 33 is provided in the cup 3 to divide the cup into two compartments.

Of course the said tray may not be formed integrally with the canteen wall and be separated as an individual piece.

To assemble the whole set, by first closing the cover 2 on to the tray side of the canteen wall, then inserting cup 3 through opening 22 of the cover 2 into the recess 14 of canteen body 1, finally screwing up the cup, the procedures are simple.

The above embodiment is given only for illustration purpose and not by way of limitation and modification will become evident to those skilled in the art which will fall within the scope of attached claims.

I claim:

1. Canteen with water color painting accessories comprising a canteen body, a tray on one of the canteen walls, a cover to be closed thereon and a cup for brush washing and having a central cylindrical recess extending through said one wall of the canteen in which the tray is formed, said tray having a plurality of partitions radially disposed around said recess to form compartments for holding tubes of water color, said cover having also a plurality of partitions therein to provide sections for color mixing, the cover further having a central opening with the same diameter as the diameter of said recess, said cup having a base of larger diameter than said recess and a cup body with a slightly smaller diameter than said recess and being suitable for insertion through the center opening of the cover as well as said recess, the cup further having male threads on the outside of the cup body to be engaged with female threads provided on the inside of said recess.

2. Canteen with water color painting accessories according to claim 1, wherein the said cup having vertical partition to divide the cup into two compartments.

3. Canteen with water color painting accessories according to claim 1, wherein said tray is a separate member.

* * * * *